US006385862B1

(12) United States Patent
Vande Haar

(10) Patent No.: US 6,385,862 B1
(45) Date of Patent: May 14, 2002

(54) METHOD AND APPARATUS FOR DRYING ARTICLES HAVING INTERNAL CAVITIES WITHIN A CLOTHES DRYER

(75) Inventor: Evan R. Vande Haar, Pella, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/874,304

(22) Filed: Jun. 6, 2001

(51) Int. Cl.[7] ..... F26B 7/00

(52) U.S. Cl. ..... 34/441; 34/315; 34/321; 34/328; 34/440; 34/90; 34/106; 34/600; 34/604

(58) Field of Search ..... 34/315, 321, 322, 34/328, 440, 441, 60, 90, 104, 105, 106, 600, 604, 194, 197, 239; 248/205.1, 206.1, 309.1

(56) References Cited

U.S. PATENT DOCUMENTS

| | | | | | |
|---|---|---|---|---|---|
| 2,076,735 | A | | 4/1937 | Leindorf | |
| 2,444,195 | A | | 6/1948 | Gruver | |
| 2,614,337 | A | | 10/1952 | Darbo | |
| 3,154,392 | A | | 10/1964 | Littman | |
| 3,256,616 | A | | 6/1966 | McGoldrick | |
| 3,299,529 | A | | 1/1967 | Roberts et al. | |
| 3,417,482 | A | | 12/1968 | Peet | |
| 3,513,564 | A | | 5/1970 | Gramprie | |
| 3,645,009 | A | | 2/1972 | Ketchum | |
| 3,793,744 | A | | 2/1974 | Saita | |
| 4,085,519 | A | | 4/1978 | Masika | |
| 4,091,548 | A | * | 5/1978 | Daily | 34/600 |
| 4,109,397 | A | * | 8/1978 | Daily | 34/239 |
| 4,136,464 | A | | 1/1979 | Hay | |
| 4,145,602 | A | | 3/1979 | Lee | |
| 4,198,765 | A | | 4/1980 | Miyamae | |
| 4,200,993 | A | | 5/1980 | Blanc et al. | |
| 4,596,078 | A | | 6/1986 | McCartney | |
| 4,677,760 | A | | 7/1987 | St. Louis | |
| 4,702,016 | A | * | 10/1987 | Grigsby | 34/499 |
| 4,768,293 | A | | 9/1988 | Kaffka | |
| 4,787,153 | A | | 11/1988 | Chen | |
| D310,742 | S | | 9/1990 | Johnson | |
| 4,981,651 | A | | 1/1991 | Horng | |
| 5,003,707 | A | | 4/1991 | Chu | |
| 5,058,289 | A | | 10/1991 | Guindon | |
| 5,179,790 | A | | 1/1993 | Poulos | |
| D335,008 | S | * | 4/1993 | Abel | D32/36 |
| 5,220,734 | A | * | 6/1993 | Carver | 34/600 |
| 5,276,979 | A | * | 1/1994 | Gordon, Sr. | 34/600 |
| 5,287,636 | A | | 2/1994 | Lafleur et al. | |
| D347,094 | S | | 5/1994 | Christensen, Jr. | |
| D349,788 | S | | 8/1994 | Laferriere et al. | |
| 5,333,393 | A | | 8/1994 | Hill et al. | |
| 5,519,949 | A | | 5/1996 | Gibson, Jr. | |
| 5,570,515 | A | | 11/1996 | Schulte | |
| 5,623,769 | A | * | 4/1997 | Hayden | 34/61 |
| 5,720,108 | A | | 2/1998 | Rice | |
| 5,729,908 | A | | 3/1998 | Braden | |
| 5,743,025 | A | | 4/1998 | Jordan, Jr. | |
| 5,776,378 | A | | 7/1998 | Knight | |
| D412,231 | S | | 7/1999 | Williams et al. | |
| D412,381 | S | | 7/1999 | Peet | |
| 6,067,723 | A | * | 5/2000 | Lafrenz | 34/61 |
| 6,067,729 | A | * | 5/2000 | Willis | 34/499 |
| 6,134,810 | A | * | 10/2000 | Stockley | 34/600 |

* cited by examiner

*Primary Examiner*—Pamela Wilson
(74) *Attorney, Agent, or Firm*—Diedericks & Whitelaw, PLC

(57) ABSTRACT

An apparatus for use in drying articles defining internal cavities within a conventional clothes dryer includes a manifold and a plurality of tubes extending therefrom. Each of the tubes is provided with various, circumferentially spaced and longitudinally extending ribs. The apparatus is adapted to be mounted within the clothes dryer, with the manifold being seated about an exhaust outlet of the dryer and a shoe, glove or the like to be dried being placed over a respective tube. Air flow into the dryer is caused to flow along the tubes, between adjacent ribs, into an internal cavity of the article, then into the manifold through the tube, and finally out of the dryer through the exhaust outlet.

20 Claims, 3 Drawing Sheets

METHOD AND APPARATUS FOR DRYING ARTICLES HAVING INTERNAL CAVITIES WITHIN A CLOTHES DRYER

BACKGROUND OF THE INVENTION

1. Field of the Invention

The present invention pertains to the art of clothes dryers and, more particularly, to an apparatus for use in drying articles having internal cavities in a clothes dryer.

2. Discussion of the Prior Art

A clothes dryer is essentially a standard appliance for a household. In general, a clothes dryer includes a cabinet within which is rotatably mounted a drum. A flow of air is drawn into the cabinet, heated, directed over moistened articles of clothing placed in a tumbling pattern within the drum in order to draw the moisture from the clothing, and exhausted. As widely known in the art, this process continues for either a pre-established time period or until a sensing arrangement signals that the clothing articles are dried to a desired level.

In addition to the drying of basic articles of clothing, it has been known to utilize a clothes dryer to dry other wearable articles. For instance, sneakers, shoes, gloves and the like can be placed in the drum for drying purposes. However, because such articles have internal cavities into which the heated air does not readily flow, either the drying time for these articles needs to be prolonged or the articles must be further air dried once removed from the clothes dryer. Of course it would be advantageous to accommodate a more efficient drying arrangement for such specialty articles.

To address this concern, there have been proposed various machines dedicated for use in drying these types of articles. For example, U.S. Pat. Nos. 2,076,735, 2,444,195, 2,614,337, 3,154,392, 3,513,564, 3,645,009, 3,793,744, 4,136,464, 4,145,602, 4,198,765, 4,200,993, 4,596,078, 4,768,293, 4,787,153, 5,003,707, 5,058,289, 5,179,790, 5,287,636, 5,570,515, 5,632,099, 5,720,108 and 5,729,908 all pertain to machines specifically designed for use in drying shoes, gloves and other similar articles by directing a flow of heated air into internal cavities of the articles. Obviously, such types of dedicated arrangements have been around for many years, but still are not popular. Basically, it is considered that providing a dedicated machine for this purpose is not cost effective as the need to dry these types of articles is fairly infrequent.

However, when the need arises, it would still be highly desirable to be able to efficiently dry such articles. To this end, it has also been proposed in the art to configure a conventional clothes dryer to accommodate a more efficient drying arrangement for shoes and the like. For example, U.S. Pat. No. 3,256,616 discloses an arrangement wherein the exhaust duct of a dryer is directed into a supplemental housing within which shoes can be placed. On the other hand, U.S. Pat. Nos. 4,677,760 and 5,333,393 teach to mount shoe supporting structure directly within a clothes dryer. In general, providing the shoe supporting structure within the clothes dryer is preferred as the overall machine can be readily adapted for this supplemental drying operation. However, the '616 arrangement actually ensures a more efficient drying operation given the manner in which the exhaust air is directed about the shoes.

In any event, although numerous attempts have been made in the prior art to provide an efficient drying arrangement for articles having internal cavities which are inherently harder to dry, there still exists a need for an apparatus which can enable a conventional clothes dryer to be effectively used to perform this function. More particularly, there exists a need for an apparatus for drying articles having internal cavities, wherein the apparatus can be readily incorporated into a clothes dryer in such a manner so as to ensure that an adequate supply of heated air will be directed through the internal cavity prior to being exhausted from the clothes dryer.

SUMMARY OF THE INVENTION

The present invention is directed to apparatus adapted to be mounted within a conventional clothes dryer in order to enable the dryer to be effectively used in drying specialty articles which define internal cavities, e.g., shoes, sneakers, hats, gloves, mittens and the like. In accordance with the preferred embodiment of the invention, the apparatus includes a plurality of hollow tubes which project from a manifold that is adapted to be releasably attached to an exhaust outlet grill of the clothes dryer. Each of the tubes preferably has a plurality of circumferentially spaced and longitudinally extending ribs on an outer surface thereof and the manifold is provided with a gasket to seat about the exhaust outlet.

In accordance with the most preferred form of the invention, the tubes are made of an elastomeric material which can readily bend in order to accommodate different sized and shaped articles, with the tubes extending into the internal cavities of the articles. The tubes can actually be removed from the manifold and replaced with different sized tubes in order to accommodate a wide range of articles to be dried. In any event, with this construction, heated air for the clothes dryer is drawn into the internal cavities of the articles between the various longitudinal ribs provided about the tubes. The air is then directed through the hollow portions of the tubes and into the manifold in order to reach the outlet for the drum. In this manner, the heated air is forced to flow directly within the internal cavities, thereby assuring that the articles will be effectively dried, both internally and externally.

Additional objects, features and advantages of the present invention will become more readily apparent from the following detailed description of a preferred embodiment when taken in conjunction with the drawing wherein like reference numerals referring to corresponding parts in the several views.

DETAILED DESCRIPTION OF THE PREFERRED EMBODIMENT

Figure 1:
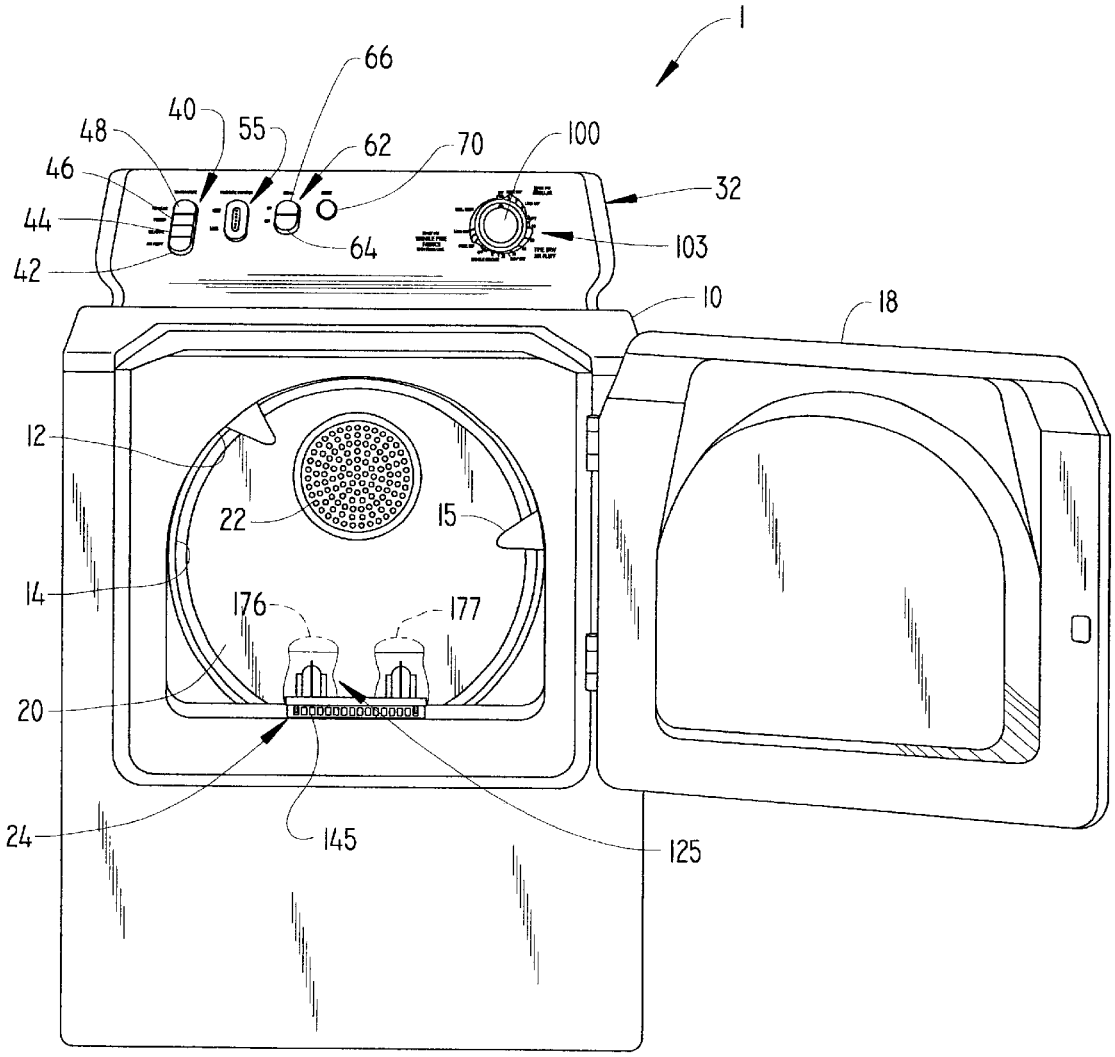
FIG. 1 is a front perspective view of a clothes dryer incorporating the article drying apparatus of the present invention.

With initial reference to FIG. 1, a clothes dryer constructed in accordance with the present invention is generally indicated at 1. As shown, clothes dryer 1 includes an outer cabinet 10 having a frontal opening 12 leading to an internal, rotatable drum 14 provided with baffles 15. A door 18 is provided for selectively closing opening 12. Within cabinet 10, clothes dryer 1 has a rear wall 20 including a heated air inlet 22. At a lower portion of opening 12 is provided a removable lint filter 24 (also see FIGS. 2 and 3) arranged in front of a grate 26 which defines an exhaust outlet for clothes dryer 1.

Disposed on an upper portion of the outer cabinet 10 is a control panel 32 for establishing a desired operational sequence for programming the clothes dryer 1. As shown, control panel 32 includes a plurality of buttons and other elements for controlling clothes dryer 1. Although control panel 32 is described below in a specific arrangement, it should be understood that the particular arrangement is only exemplary, as a wide range of layouts would suffice. In any event, disposed on the left side of control panel 32 is a temperature selector 40 which includes buttons for determining the heat output of clothes dryer 1. In the most preferred embodiment, temperature selector 40 includes an air fluff button 42, a delicate button 44, a medium button 46 and a regular button 48.

Next to temperature selector 40 is a moisture monitor 55 for displaying the current moisture state of articles contained within clothes dryer 1. In the embodiment shown, moisture monitor 55 is defined by a set of LEDs for indicating the specific moisture level of articles of clothing placed in drum 14 based on signals received and processed from a moisture detector generally indicated at 57 in FIG. 2.

Proximate to moisture monitor 55 is a signal controller 62. Signal controller 62 is provided to selectively regulate the operation of a buzzer (not shown), and includes an OFF button 64 and an ON button 66. The selection of ON button 66 causes the buzzer to sound upon completion of the drying operation, while selection of OFF button 64 prevents the buzzer from sounding upon completion of the drying operation. Additionally, control panel 22 includes a start button 70 for commencing operation of clothes dryer 1. Finally, control panel 22 includes a control dial 100 for programming clothes dryer 1. Annularly disposed about the periphery of dial 100 is indicia 103 which illustrates various potential settings, preferably various sense dry and a time-dry zones designed to indicate the mode of dryer operation, i.e. a sense-dry mode or a time-dry mode.

Figure 2:
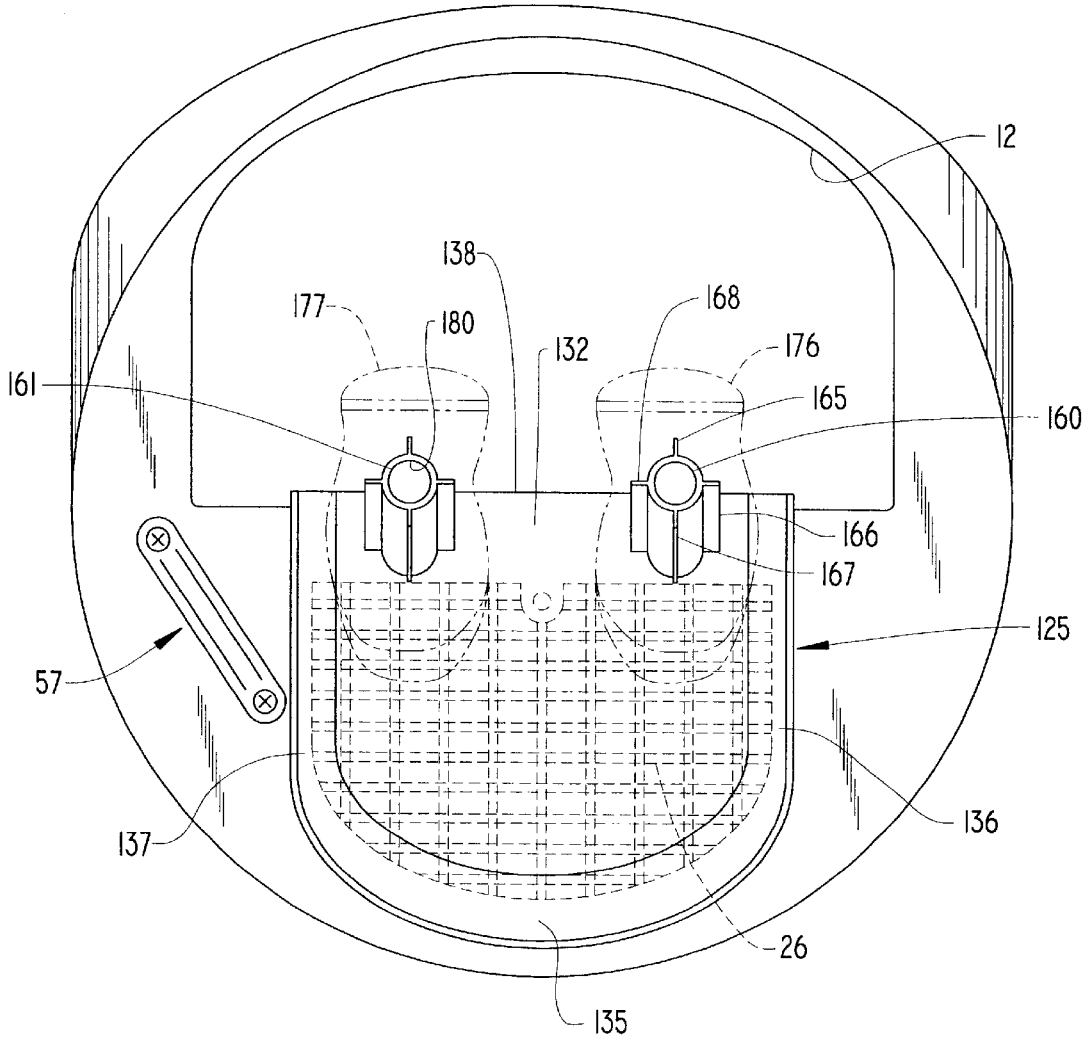
FIG. 2 is a rear view of an inner front wall of the clothes dryer of FIG. 1.
Figure 3:
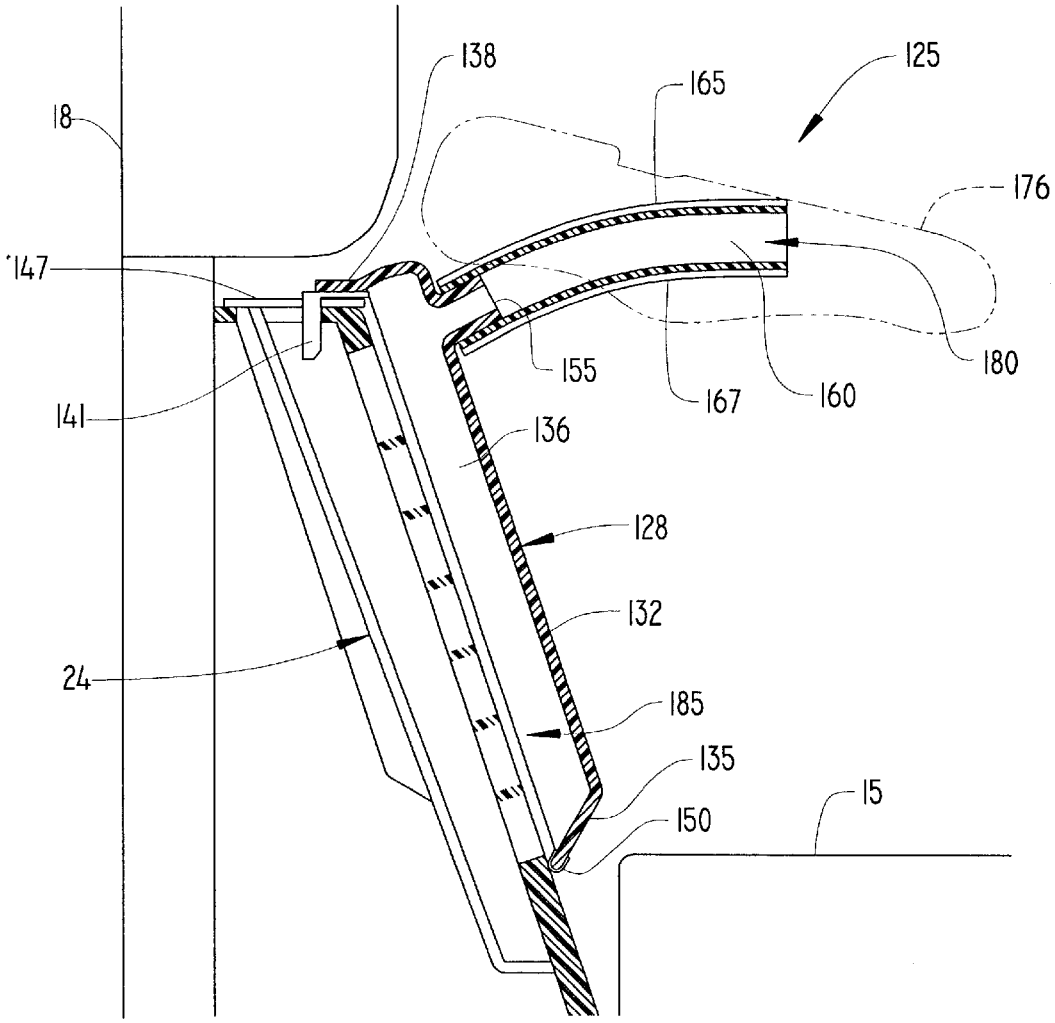
FIG. 3 is a cross-sectional side view of a frontal portion of the clothes dryer of FIG. 1.

Since the general structure and the corresponding operation of clothes dryer 1, as described to this point, is known in the art, does not form part of the present invention, and has only been provided for the sake of completeness, no further details on these features will be provided here. Instead, the present invention is particularly directed to the inclusion of an apparatus 125 which is adapted to be selectively mounted within drum 14 and used in connection with drying articles having internal cavities, such as shoes, sneakers, hats, gloves and the like. As best shown in FIGS. 2 and 3, apparatus 125 includes a manifold member 128 defined by a main manifold body in the form of a plate 132, a lower side wall 135, opposing lateral side walls 136 and 137, and an upper wall 138. Depending from upper wall 138 are a plurality of laterally spaced hang tabs, one of which is shown at 141.

Apparatus 125 is adapted to be mounted within clothes dryer 1 with hang tabs 141 extending into respective slots 145 formed in a cover piece 147 of lint filter 24. When set in position, upper wall 138 extends along cover piece 147 and each of angled side walls 135–137 extends about a respective portion of grate 26. In accordance with a preferred form of the invention, terminal portions of at least side walls 135–137 have attached thereto a gasket 150. With this construction, apparatus 125 is seated about the air exhaust outlet as defined by grate 26.

In the embodiment shown, main plate 132 is formed with a pair of spaced nozzles 155. Extending from each nozzle 155 is a respective tube 160, 161. Each tube 160, 161 is formed with a plurality of longitudinally extending and circumferentially spaced ribs 165–168. In the most preferred form of the invention, manifold member 128 is molded of plastic and tubes 160 and 161 are formed of an elastically bendable material.

Tubes 160 and 161 are adapted to project into and support articles to be dried, such as shoes 176 and 177 respectively. That is, during use, apparatus 125 is hung about grate 26 so as to assume the position shown in FIGS. 2 and 3. Shoes 176 and 177 can then be supported on tubes 160 and 161 respectively, with tubes 160 and 161 projecting into internal cavities (not separately labeled) of shoes 176 and 177. Since main plate 132 covers grate 26, the heated air directed into drum 14 through air inlet 22 is forced to flow along portions of tubes 160 and 161, between adjacent ribs 165–168, and into the internal cavities defined by the shoes 176 and 177. The air can then flow into an internal passage 180 associated with each tube 160, 161 which leads to a common manifold chamber 185. Since manifold chamber 185 is exposed to grate 26, the air can then be readily exhausted through lint filter 24.

Based on the above, it should be readily apparent that apparatus of the invention enables a conventional clothes dryer to be readily adapted for use in drying articles having internal cavities, e.g., shoes, sneakers, hats, gloves and the like. Since the heated air is forced both about and through the article(s), an overall efficient drying arrangement is defined. If desired, additional clothing can be simultaneously dried within drum 14. Tubes 160 and 161 can also be readily detached from nozzles 155 and replaced with other tubular support members of varying sizes and/or shapes. For example, when drying gloves, support members including multiple "finger" tubes could be employed. Also, the exact number of article support members can vary. In any event, although described with reference to a preferred embodiment of the invention, it should be readily understood that various changes and/or modifications can be made to the invention without departing from the spirit thereof. In general, the invention is only intended to be limited by the scope of the following claims.

What is claimed is:

1. A clothes dryer comprising:

an outer cabinet;

a drum rotatably mounted within said outer cabinet, said drum being configured to receive clothing to be heated and dried within said drum;

a heated air inlet leading into the drum;

an air exhaust outlet leading from the drum; and an apparatus for supporting articles to be dried within the clothes dryer, said apparatus including a manifold member mounted about the air exhaust outlet and at least one article support connected to and extending from the manifold member.

2. The clothes dryer according to claim 1, wherein said at least one article support includes a plurality of tubes connected to and extending from the manifold member.

3. The clothes dryer according to claim 2, wherein the manifold member defines a manifold chamber exposed to the air exhaust outlet, each of said tubes including an internal passage in fluid communication with the manifold chamber.

4. The clothes dryer according to claim 3, further comprising: a plurality of longitudinal ribs extending along each of said tubes.

5. The clothes dryer according to claim 3, wherein each of said tubes is formed of an elastic material.

6. The clothes dryer according to claim 1, further comprising: at least one hang tab extending from the manifold member for supporting the apparatus within the clothes dryer.

7. The clothes dryer according to claim 1, further comprising: a gasket for seating the manifold member about the air exhaust outlet.

8. An apparatus for supporting articles to be dried within a drum of a clothes dryer having a heated air inlet and an air exhaust outlet comprising:

a manifold member configured to be mounted about the air exhaust outlet; and at least one article support connected to and extending from the manifold member.

9. The apparatus according to claim 8, wherein said at least one article support includes a plurality of tubes connected to and extending from the manifold member.

10. The apparatus according to claim 9, wherein the manifold member defines a manifold chamber configured to be exposed to the air exhaust outlet, each of said tubes including an internal passage in fluid communication with the manifold chamber.

11. The apparatus according to claim 10, further comprising: a plurality of longitudinal ribs extending along each of said tubes.

12. The apparatus according to claim 10, wherein each of said tubes is formed of an elastic material.

13. The apparatus according to claim 8, further comprising: at least one hang tab extending from the manifold member for supporting the apparatus within the clothes dryer.

14. The apparatus according to claim 8, further comprising: a gasket for use in seating the manifold member about the air exhaust outlet.

15. The apparatus according to claim 8, wherein the manifold member is formed with a nozzle and the at least one article support is detachably connected to the nozzle.

16. A method of supporting and drying articles within a clothes dryer comprising:

mounting a manifold member at an air exhaust outlet of the clothes dryer;

supporting an article to be dried from the manifold member; and operating the clothes dryer such that heated air is directed into the article to be dried prior to being delivered to the exhaust outlet.

17. The method according to claim 16, wherein the heated air is directed into the article between ribs provided on tubes projecting from the manifold member.

18. The method according to claim 17, further comprising: re-directing the heated air to flow through the tubes and to the exhaust outlet.

19. The method according to claim 16, further comprising: seating the manifold member about the air exhaust outlet through a gasket.

20. The method according to claim 16, further comprising: hanging the manifold member within the clothes dryer.

* * * * *